US008083383B2

(12) United States Patent
Chen

(10) Patent No.: US 8,083,383 B2
(45) Date of Patent: Dec. 27, 2011

(54) ILLUMINATION DEVICE

(75) Inventor: Ying-Zhong Chen, Taipei County (TW)

(73) Assignee: Everlight Electronics Co., Ltd., Taipei (TW)

( * ) Notice: Subject to any disclaimer, the term of this patent is extended or adjusted under 35 U.S.C. 154(b) by 48 days.

(21) Appl. No.: 12/779,460

(22) Filed: May 13, 2010

(65) Prior Publication Data

US 2011/0080732 A1 Apr. 7, 2011

(30) Foreign Application Priority Data

Oct. 2, 2009 (TW) ..... 98133582 A

(51) Int. Cl.
*F21V 29/00* (2006.01)

(52) U.S. Cl. ..... 362/373; 362/294

(58) Field of Classification Search ..... 362/373, 362/294

See application file for complete search history.

(56) References Cited

U.S. PATENT DOCUMENTS

| | | | | |
|---|---|---|---|---|
| 5,458,505 | A | 10/1995 | Prager | |
| 7,144,140 | B2 * | 12/2006 | Sun et al. | 362/373 |
| 7,575,346 | B1 * | 8/2009 | Horng et al. | 362/373 |
| 2005/0174780 | A1 * | 8/2005 | Park | 362/294 |
| 2009/0091487 | A1 * | 4/2009 | Viswanathan et al. | 341/155 |
| 2009/0237937 | A1 | 9/2009 | Liu | |

FOREIGN PATENT DOCUMENTS

| | | |
|---|---|---|
| EP | 2 025 992 | 2/2009 |
| TW | M241584 | 8/2004 |
| WO | WO 2008/146694 | 12/2008 |

* cited by examiner

*Primary Examiner* — Laura Tso

(74) *Attorney, Agent, or Firm* — Muncy, Geissler, Olds & Lowe, PLLC

(57) ABSTRACT

An illumination device. A control circuit module is disposed in a first base. A second base is detachably connected to the first base. A heat-dissipation module is disposed in the second base and is electrically connected to the control circuit module. A first fastening ring fastens the first base with the second base. A third base is detachably connected to the second base. A light source module is disposed in the third base and is electrically connected to the heat-dissipation module. A second fastening ring fastens the second base with the third base.

16 Claims, 5 Drawing Sheets

ILLUMINATION DEVICE

CROSS REFERENCE TO RELATED APPLICATIONS

This Application claims priority of Taiwan Patent Application No. 98133582, filed on Oct. 2, 2009, the entirety of which is incorporated by reference herein.

BACKGROUND OF THE INVENTION

1. Field of the Invention

The invention relates to an illumination device, and more particularly to an illumination device that can be easily assembled and disassembled.

2. Description of the Related Art

Generally, a conventional light-emitting diode (LED) illumination device comprises an LED module, a heat-dissipation mechanism, and a control circuit. Under normal operation of the LED illumination device, the lifespan of the heat-dissipation mechanism (such as, a fan) is approximately 30,000 hours to 50,000 hours, the lifespan of the LED module is approximately 50,000 hours to 100,000 hours, and the control circuit provides a much longer lifespan. Therefore, after the LED illumination device is operated for a period of time, some components (such as, the heat-dissipation mechanism or LED module) therein may malfunction and need to be replaced. However, since the LED module, heat-dissipation mechanism, and control circuit are often fixed to one another, assembly and disassembly thereof is complex and inconvenient. Accordingly, when some of the components of the LED illumination device malfunction, the entire LED illumination device must be replaced by another one, thereby wasting resources and increasing disbursement costs.

Hence, there is a need for an illumination device with simplified assembly and disassembly, facilitating replacement of components thereof.

BRIEF SUMMARY OF THE INVENTION

A detailed description is given in the following embodiments with reference to the accompanying drawings.

An exemplary embodiment of the invention provides an illumination device comprising a first base, a control circuit module, a second base, a heat-dissipation module, a first fastening ring, a third base, a light source module, and a second fastening ring. The control circuit module is disposed in the first base. The second base is detachably connected to the first base. The heat-dissipation module is disposed in the second base and is electrically connected to the control circuit module. The first fastening ring fastens the first base with the second base. The third base is detachably connected to the second base. The light source module is disposed in the third base and is electrically connected to the heat-dissipation module. The second fastening ring fastens the second base with the third base.

The control circuit module comprises at least one first power connection portion. The heat-dissipation module comprises at least one second power connection portion and at least one third power connection portion. The light source module comprises at least one fourth power connection portion. The second power connection portion is inserted into the first power connection portion. The fourth power connection portion is inserted into the third power connection portion.

The third base further comprises a heat sink connected to the light source module and opposite the heat-dissipation module.

The first base has a first thread portion. The first fastening ring is screwed on the first thread portion of the first base and abuts the second base.

The first fastening ring abuts a first retardant portion of the second base so as to fasten the first base and the second base.

The first fastening ring abuts a first retardant portion of the second base so as to fasten the first base and the second base.

The second base has a second thread portion. The second fasten ring is screwed on the second thread portion and abuts the third base.

The second base has a second thread portion. The second fasten ring is screwed on the second thread portion and abuts the third base.

The third base further comprises a second retardant portion. The second fastening ring abuts the second retardant portion, fastening the second base with the third base.

The third base further comprises a second retardant portion. The second fastening ring abuts the second retardant portion, fastening the second base with the third base.

The first fastening ring comprises a third threaded portion and a third retardant portion. The third threaded portion engages the first threaded portion. The third retardant portion abuts the first retardant portion.

The first fastening ring comprises a third threaded portion and a third retardant portion. The third threaded portion engages the first threaded portion. The third retardant portion abuts the first retardant portion.

The second fastening ring comprises a fourth threaded portion and a fourth retardant portion. The fourth threaded portion engages the second threaded portion. The fourth retardant portion abuts the second retardant portion.

The second fastening ring comprises a fourth threaded portion and a fourth retardant portion. The fourth threaded portion engages the second threaded portion. The fourth retardant portion abuts the second retardant portion.

The heat-dissipation module further comprises a fan. The second base further comprises at least one heat-dissipation vent.

The light source module further comprises at least one light-emitting diode.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
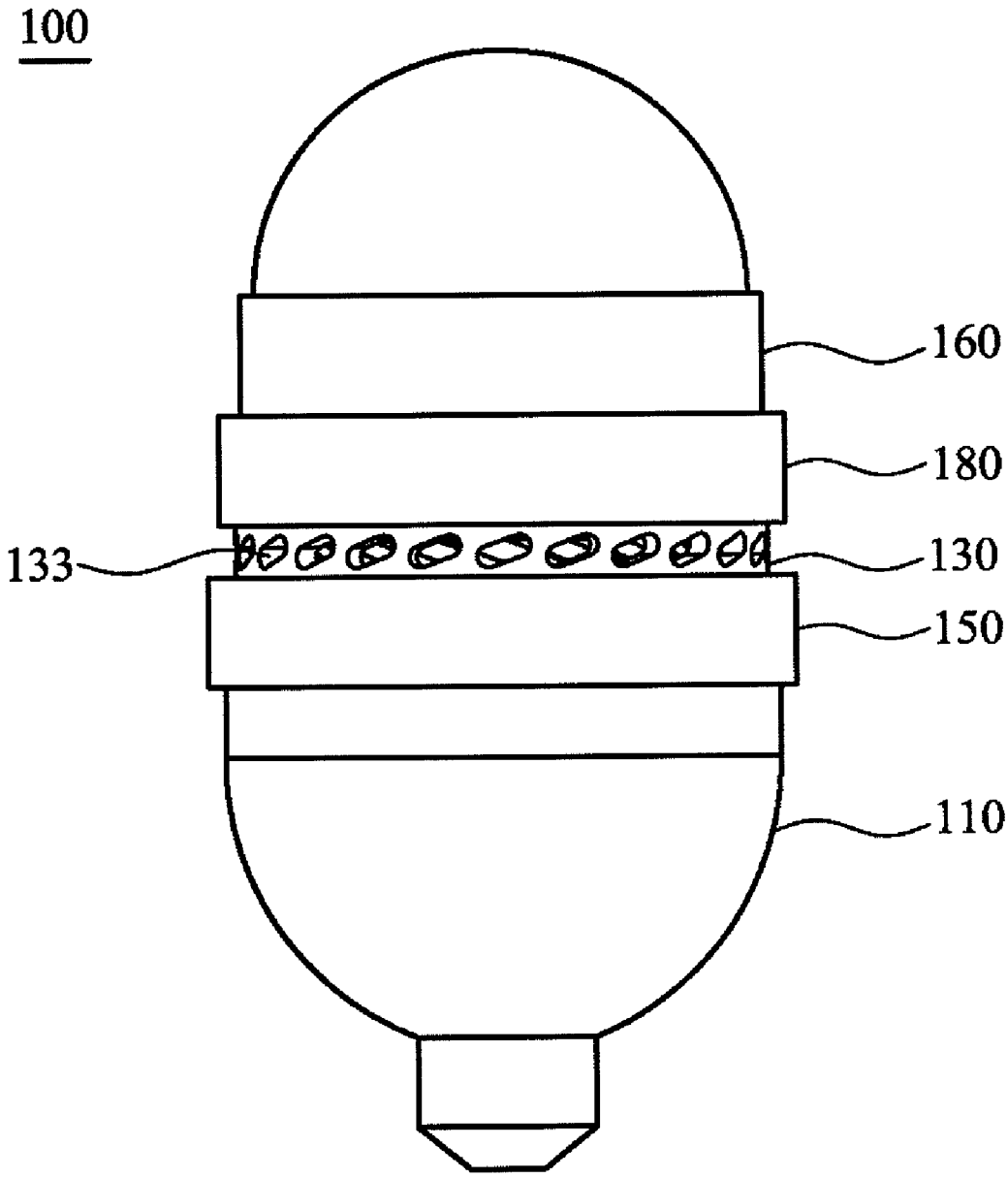
FIG. 1A is a schematic assembly view of an illumination device of the invention.
Figure 1B:
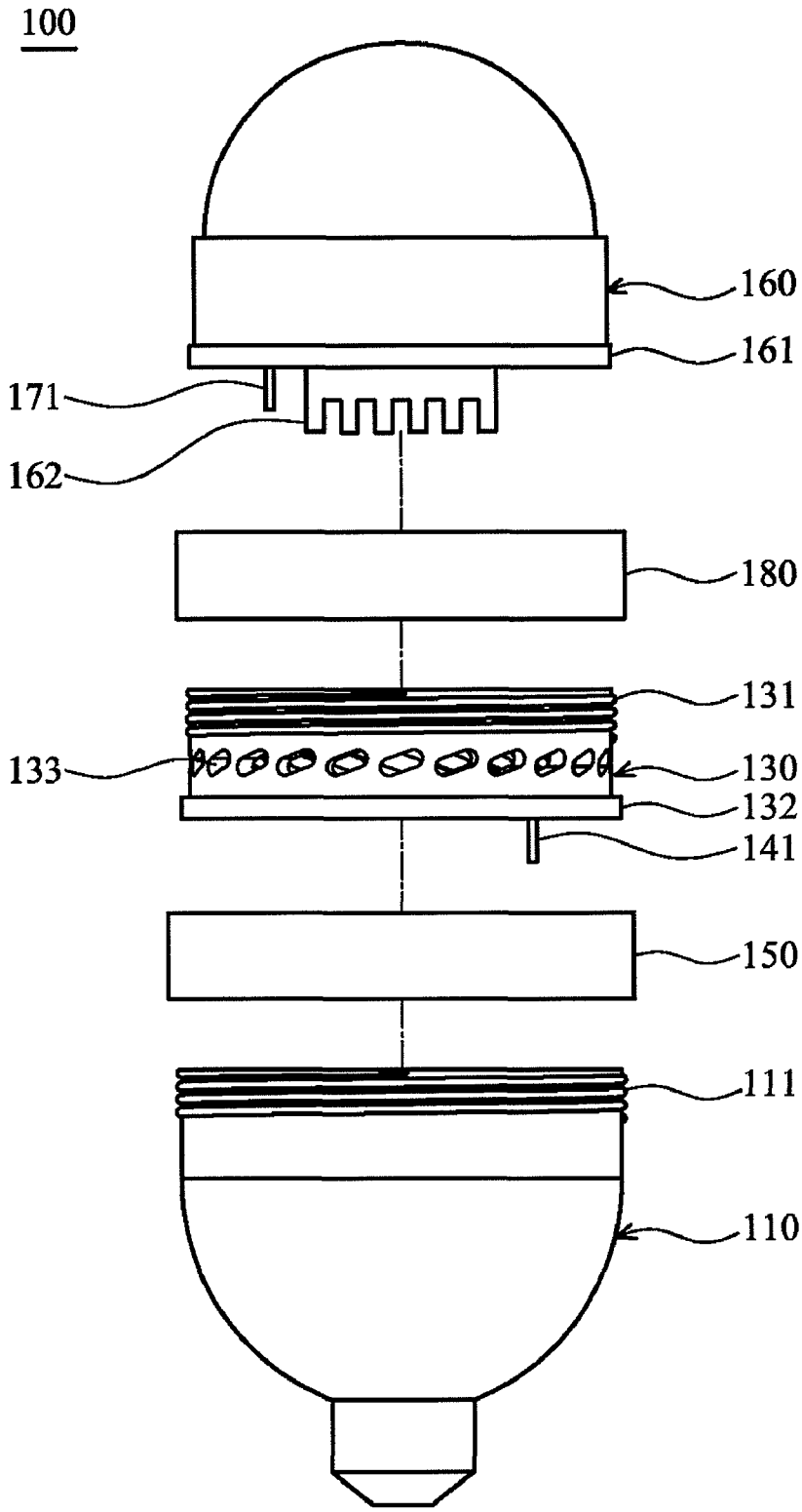
FIG. 1B is a schematic exploded view of the illumination device of the invention.
Figure 2:
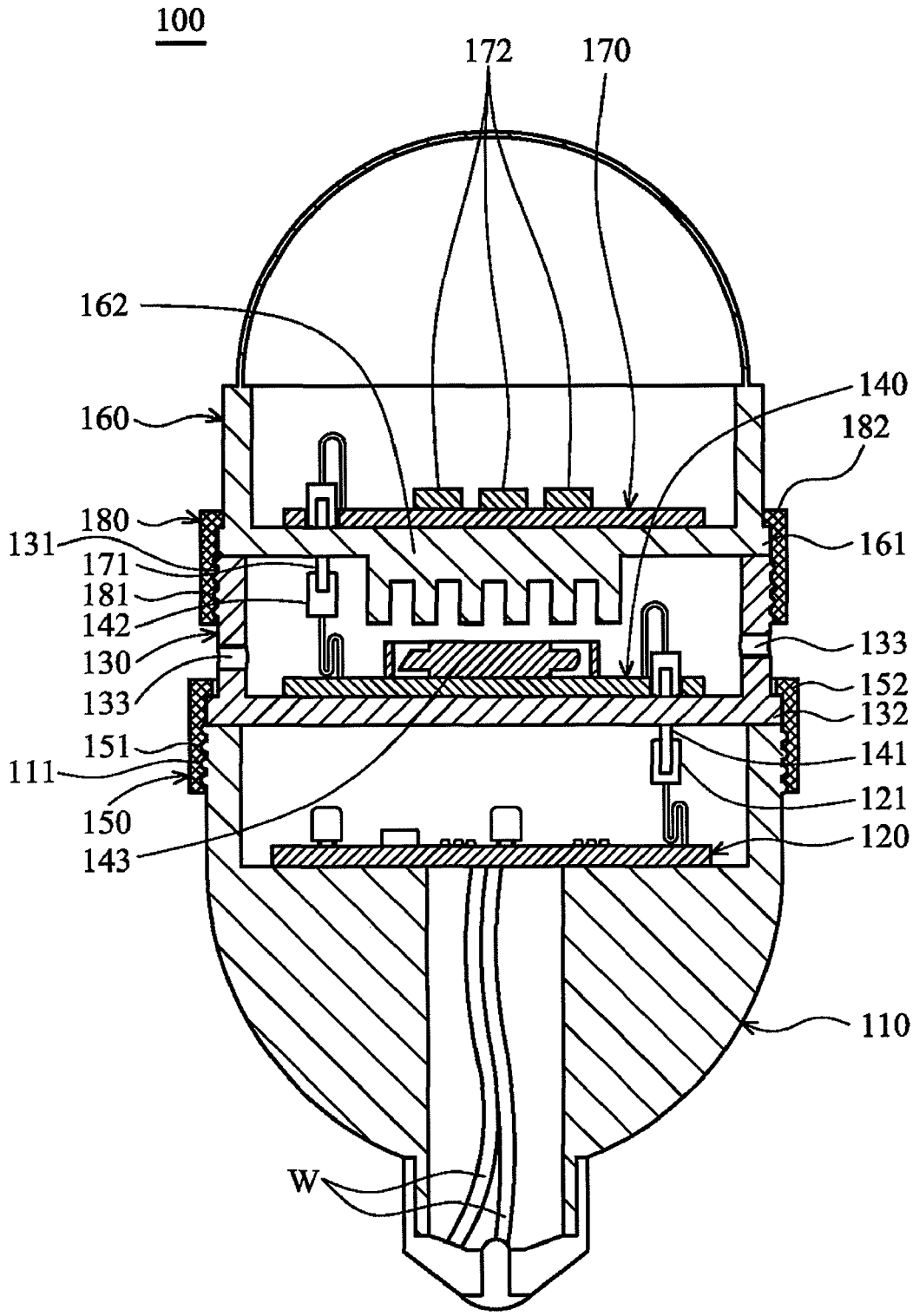
FIG. 2 is a schematic cross section of the illumination device of the invention.

Referring to FIGS. 1A, 1B, and 2, an illumination device 100 comprises a first base 110, a control circuit module 120, a second base 130, a heat-dissipation module 140, a first fastening ring 150, a third base 160, a light source module 170, and a second fastening ring 180.

As shown in FIG. 1B, the first base 110 comprises a first threaded portion 111.

As shown in FIG. 2, the control circuit module 120 is disposed in the first base 110. Here, the control circuit module 120 may be connected to an external power source (not shown) by two wires W. Additionally, the control circuit module 120 comprises two first power connection portions 121. Here, only one first power connection portion 121 is shown in FIG. 2. In this embodiment, the first power connection portions 121 are sockets.

As shown in FIG. 1B and FIG. 2, the second base 130 is detachably connected to the first base 110 and comprises a second threaded portion 131, a first retardant portion 132, and a plurality of heat-dissipation vents 133.

As shown in FIG. 2, the heat-dissipation module 140 is disposed in the second base 130 and is detachably and electrically connected to the control circuit module 120. Specifically, the heat-dissipation module 140 comprises two second power connection portions 141, two third power connection portions 142, and a fan 143. Here, only one second power connection portion 141 and only one third power connection portion 142 are shown in FIG. 2. In this embodiment, the second power connection portions 141 and third power connection portions 142 are plugs and sockets, respectively. Accordingly, when the heat-dissipation module 140 is electrically connected to the control circuit module 120, the second power connection portions 141 are connected to the first power connection portions 121, i.e. the second power connection portions 141 (plugs) are inserted into the first power connection portions 121 (sockets).

As shown in FIG. 1B and FIG. 2, the first fastening ring 150 is screwed on the first threaded portion 111 of the first base 110 and tightly abuts the first retardant portion 132 of the second base, fastening the first base 110 with the second base 130. Specifically, as shown in FIG. 2, the first fastening ring 150 comprises a third threaded portion 151 and a third retardant portion 152. As shown in FIG. 1B and FIG. 2, when the first base 110 is fastened with the second base 130 by the first fastening ring 150, the third threaded portion 151 engages the first threaded portion 111, and the third retardant portion 152 abuts the first retardant portion 132. Accordingly, combination between the first base 110 and the second base 130 is not accomplished by relative rotation therebetween.

As shown in FIG. 1B and FIG. 2, the third base 160 is detachably connected to the second base 130 and comprises a second retardant portion 161 and a heat sink 162.

As shown in FIG. 2, the light source module 170 is disposed in the third base 160 and is detachably and electrically connected to the heat-dissipation module 140. Specifically, the light source module 170 comprises two fourth power connection portions 171 and a plurality of light-emitting diodes 172. Here, only one fourth power connection portion 171 is shown in FIG. 2. In this embodiment, the fourth power connection portions 171 are plugs. Accordingly, when the light source module 170 is electrically connected to the heat-dissipation module 140, the fourth power connection portions 171 are connected to the third power connection portions 142, i.e. the fourth power connection portions 171 (plugs) are inserted into the third power connection portions 142 (sockets). By connection between the first power connection portions 121 and the second power connection portions 141 and between the third power connection portions 142 and the fourth power connection portions 171, the control circuit module 120 can sequentially supply power to the heat-dissipation module 140 and light source module 170, driving (the fan 143 of) the heat-dissipation module 140 to perform heat dissipation and enabling (the light-emitting diodes 172 of) the light source module 170 to emit light. Additionally, the heat sink 162 of the third base 160 is connected to the light source module 170, is opposite the heat-dissipation module 140, and is disposed in the second base 130. Thus, heat generated by operation of the light source module 170 is conducted to the interior of the second base 130 by the heat sink 162 and is then transmitted to the exterior of the illumination device 100 (via the heat-dissipation vents 133 of the second base 130) by the fan 143.

As shown in FIG. 1B and FIG. 2, the second fastening ring 180 is screwed on the second threaded portion 131 of the second base 130 and tightly abuts the second retardant portion 161 of the third base 160, fastening the second base 130 with the third base 160. Specifically, as shown in FIG. 2, the second fastening ring 180 comprises a fourth threaded portion 181 and a fourth retardant portion 182. As shown in FIG. 1B and FIG. 2, when the second base 130 is fastened with the third base 160 by the second fastening ring 180, the fourth threaded portion 181 engages the second threaded portion 131 and the fourth retardant portion 182 abuts the second retardant portion 161. Accordingly, combination between the second base 130 and the third base 160 is not accomplished by relative rotation therebetween.

The following description is directed to assembly of the illumination device 100.

Figure 3A:
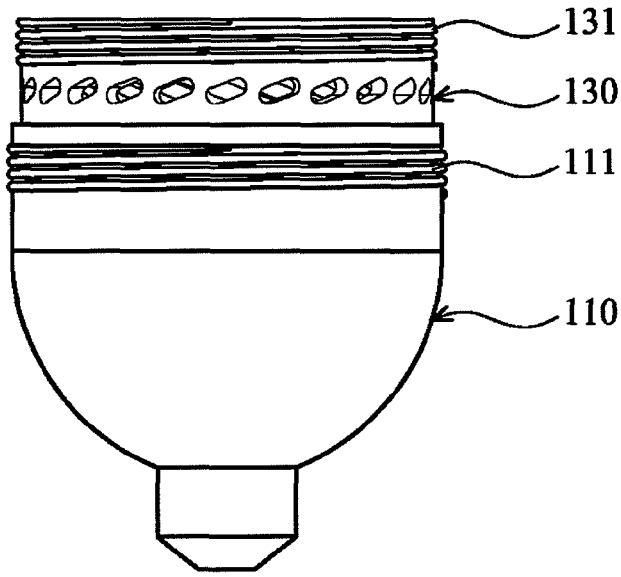
FIG. 3A is a schematic view showing the illumination device of the invention in an assembly mode.
Figure 3B:
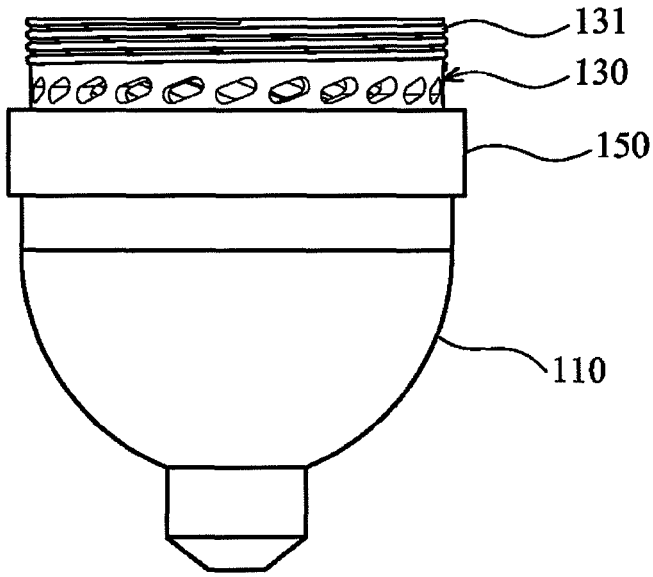
FIG. 3B is a schematic view showing the illumination device of the invention in another assembly mode.
Figure 3C:
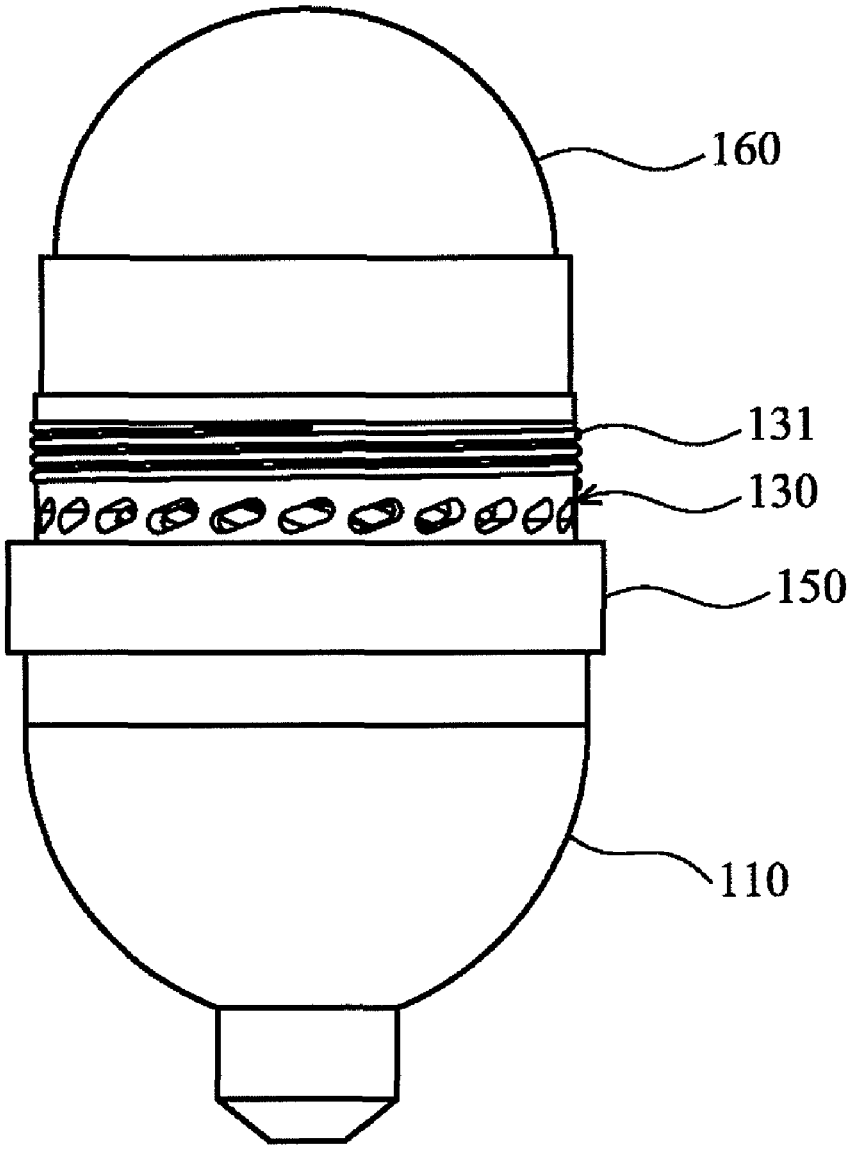
FIG. 3C is a schematic view showing the illumination device of the invention in yet another assembly mode.

The second power connection portions 141 (plugs) of the heat-dissipation module 140 disposed in the second base 130 are inserted into the first power connection portions 121 (sockets) of the control circuit module 120 disposed in the first base 110, connecting the second base 130 to the first base 110, as shown in FIG. 3A. Next, the first fastening ring 150 is screwed on the first threaded portion 111 of the first base 110, fastening the first base 110 with the second base 130, as shown in FIG. 3B. Next, the fourth power connection portions 171 (plugs) of the light source module 170 disposed in the third base 160 are inserted into the third power connection portions 142 (sockets) of the heat-dissipation module 140 disposed in the second base 130, connecting the third base 160 to the second base 130, as shown in FIG. 3C. Then, the second fastening ring 180 is screwed on the second threaded portion 131 of the second base 130, fastening the second base 130 with the third base 160. At this point, the assembly of the illumination device 100 is complete, as shown in FIG. 1A.

In another aspect, the foregoing steps can be reversely performed to disassemble the illumination device 100, wherein the description thereof is omitted.

In conclusion, the assembly and disassembly of the illumination device 100 are easy and simplified, such that electrical connection between the control circuit module 120, the heat-dissipation module 140, and the light source module 170 is not adversely affected. Thus, when some components (such as, the control circuit module 120, heat-dissipation module 140, or light source module 170) in the illumination device 100 malfunction, a user can easily disassemble the illumination device 100 to replace the components (such as, the first base 110, second base 130, or third base 160) rather than replacing the entire illumination device 100, reducing wasted resources and disbursement costs for the user.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An illumination device, comprising:

a first base;

a control circuit module disposed in the first base;

a second base detachably connected to the first base;

a heat-dissipation module disposed in the second base and electrically connected to the control circuit module;

a first fastening ring fastening the first base with the second base;

a third base detachably connected to the second base;

a light source module disposed in the third base and electrically connected to the heat-dissipation module; and a second fastening ring fastening the second base with the third base.

2. The illumination device as claimed in claim 1, wherein the control circuit module comprises at least one first power connection portion, the heat-dissipation module comprises at least one second power connection portion and at least one third power connection portion, the light source module comprises at least one fourth power connection portion, the second power connection portion is inserted into the first power connection portion, and the fourth power connection portion is inserted into the third power connection portion.

3. The illumination device as claimed in claim 1, wherein the third base further comprises a heat sink connected to the light source module and opposite the heat-dissipation module.

4. The illumination device as claimed in claim 1, wherein the first base having a first thread portion, and the first fastening ring is screwed on the first thread portion of the first base and abuts the second base.

5. The illumination device as claimed in claim 4, wherein the first fastening ring abuts a first retardant portion of the second base so as to fasten the first base and the second base.

6. The illumination device as claimed in claim 1, wherein the first fastening ring abuts a first retardant portion of the second base so as to fasten the first base and the second base.

7. The illumination device as claimed in claim 1, wherein the second base having a second thread portion, and the second fasten ring is screwed on the second thread portion and abuts the third base.

8. The illumination device as claimed in claim 4, wherein the second base having a second thread portion, and the second fasten ring is screwed on the second thread portion and abuts the third base.

9. The illumination device as claimed in claim 1, wherein the third base further comprises a second retardant portion, and the second fastening ring abuts the second retardant portion, fastening the second base with the third base.

10. The illumination device as claimed in claim 9, wherein the third base further comprises a second retardant portion, and the second fastening ring abuts the second retardant portion, fastening the second base with the third base.

11. The illumination device as claimed in claim 5, wherein the first fastening ring comprises a third threaded portion and a third retardant portion, the third threaded portion engages the first threaded portion, and the third retardant portion abuts the first retardant portion.

12. The illumination device as claimed in claim 6, wherein the first fastening ring comprises a third threaded portion and a third retardant portion, the third threaded portion engages the first threaded portion, and the third retardant portion abuts the first retardant portion.

13. The illumination device as claimed in claim 9, wherein the second fastening ring comprises a fourth threaded portion and a fourth retardant portion, the fourth threaded portion engages the second threaded portion, and the fourth retardant portion abuts the second retardant portion.

14. The illumination device as claimed in claim 10, wherein the second fastening ring comprises a fourth threaded portion and a fourth retardant portion, the fourth threaded portion engages the second threaded portion, and the fourth retardant portion abuts the second retardant portion.

15. The illumination device as claimed in claim 1, wherein the heat-dissipation module further comprises a fan, and the second base further comprises at least one heat-dissipation vent.

16. The illumination device as claimed in claim 1, wherein the light source module further comprises at least one light-emitting diode.

* * * * *